US007992689B2

(12) United States Patent
Stolt et al.

(10) Patent No.: US 7,992,689 B2
(45) Date of Patent: Aug. 9, 2011

(54) MOVEMENT CONTROL OF AN ELEVATOR SYSTEM USING POSITION DEVIATION TO DETERMINE LOADING STATE

(75) Inventors: Lauri Stolt, Helsinki (FI); Tuukka Kauppinen, Hyvinkää (FI)

(73) Assignee: Kone Corporation, Helinki (FI)

( * ) Notice: Subject to any disclaimer, the term of this patent is extended or adjusted under 35 U.S.C. 154(b) by 0 days.

(21) Appl. No.: 12/826,151

(22) Filed: Jun. 29, 2010

(65) Prior Publication Data

US 2010/0300815 A1 Dec. 2, 2010

Related U.S. Application Data

(63) Continuation of application No. PCT/FI2009/000003, filed on Jan. 8, 2009.

(30) Foreign Application Priority Data

Jan. 9, 2008 (FI) ..... 20080018

(51) Int. Cl.
*B66B 1/34* (2006.01)

(52) U.S. Cl. ..... 187/393; 187/281

(58) Field of Classification Search ..... 187/247, 187/293, 288, 281, 296, 297, 391–393; 318/799–815
See application file for complete search history.

(56) References Cited

U.S. PATENT DOCUMENTS

| | | | | | |
|---|---|---|---|---|---|
| 2,149,452 | A * | 3/1939 | Lewis et al. | ..... | 187/296 |
| 2,557,179 | A * | 6/1951 | Fish et al. | ..... | 187/286 |
| 2,619,197 | A * | 11/1952 | Glaser et al. | ..... | 187/385 |
| 5,025,896 | A * | 6/1991 | Arabori et al. | ..... | 187/292 |
| 5,077,508 | A * | 12/1991 | Wycoff et al. | ..... | 318/436 |
| 5,407,030 | A | 4/1995 | Burton et al. | | |
| 5,734,135 | A * | 3/1998 | Hakala et al. | ..... | 187/292 |
| 5,777,280 | A * | 7/1998 | Braasch et al. | ..... | 187/393 |
| 6,283,252 | B1 * | 9/2001 | Lee | ..... | 187/291 |
| 6,401,875 | B1 * | 6/2002 | Marvin et al. | ..... | 187/393 |
| 7,176,677 | B2 * | 2/2007 | Narumi et al. | ..... | 324/207.25 |
| 2003/0076068 | A1 * | 4/2003 | Pollock et al. | ..... | 318/685 |
| 2007/0227828 | A1 * | 10/2007 | Kinpara et al. | ..... | 187/295 |

FOREIGN PATENT DOCUMENTS

| | | | |
|---|---|---|---|
| EP | 0 626 333 | A1 | 11/1994 |
| JP | 10-167595 | A | 6/1998 |
| JP | 2006-321642 | A | 11/2006 |
| JP | 2007-221887 | A | 8/2007 |

* cited by examiner

*Primary Examiner* — Jonathan Salata
(74) *Attorney, Agent, or Firm* — Birch, Stewart, Kolasch & Birch, LLP

(57) ABSTRACT

A determination of the loading state of an elevator system and also a method for determining the loading state of an elevator system is described. The elevator system includes an elevator car and also a motor drive for moving the elevator car. The loading state of the elevator system is determined on the basis of the position deviation of the elevator motor that occurs during the determination of the loading state.

10 Claims, 2 Drawing Sheets

Figure 1:
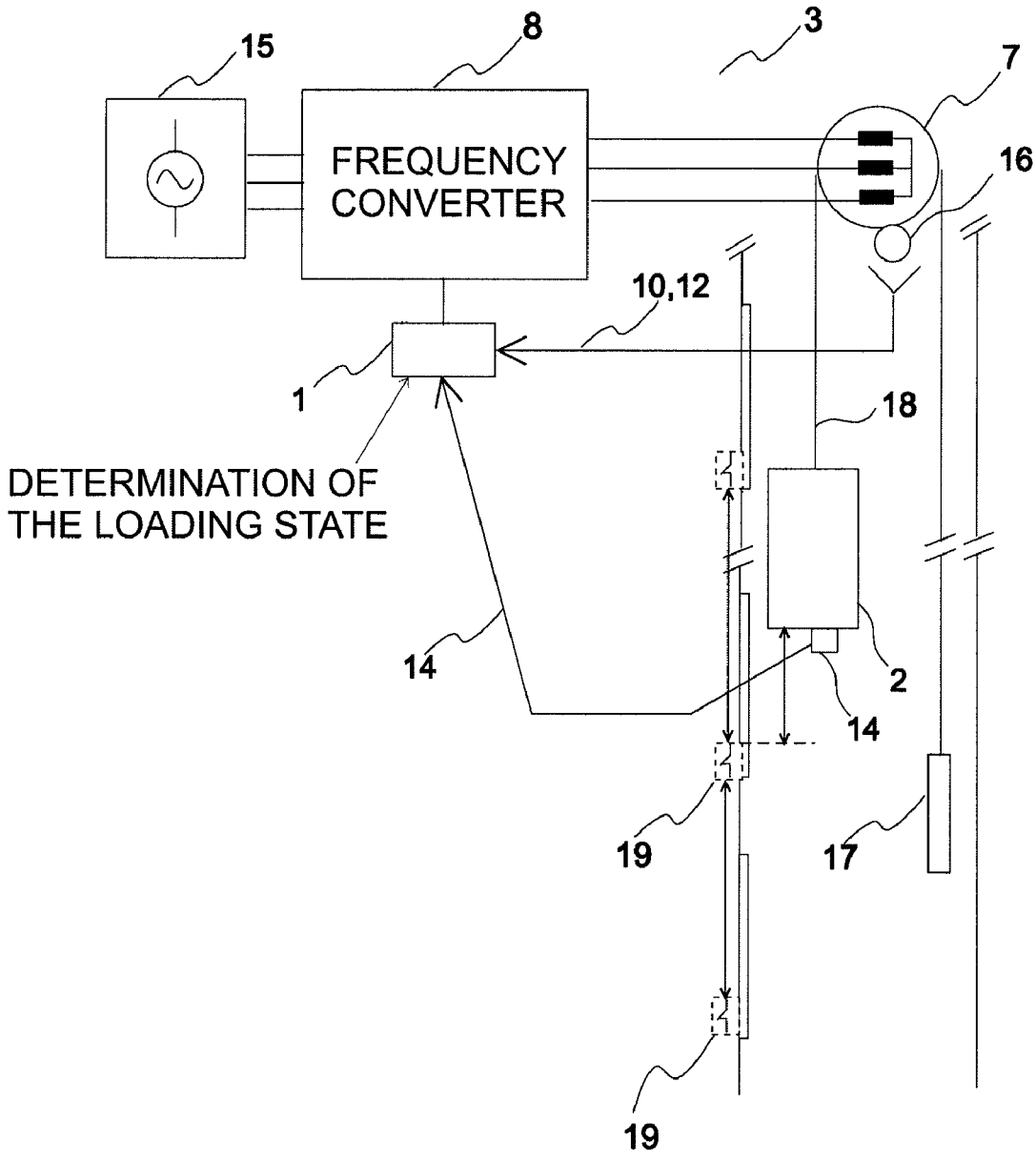

MOVEMENT CONTROL OF AN ELEVATOR SYSTEM USING POSITION DEVIATION TO DETERMINE LOADING STATE

CROSS REFERENCE TO RELATED APPLICATIONS

This non-provisional application is a continuation of PCT/FI2009/000003 filed on Jan. 8, 2009, and claims priority under 35 U.S.C. §119(a) to Patent Application No. 20080018 filed in Finland, on Jan. 9, 2008. The entire contents of all of the above applications is hereby incorporated by reference.

FIELD OF THE INVENTION

The object of this invention is a determination of the loading state of an elevator system, a movement control of an elevator system and also a method for determining the loading state of an elevator system.

PRIOR ART

In elevator systems with counterweight the position of equilibrium of the loading is determined according to the weights of the elevator car and of the counterweight. In the position of equilibrium the counterweight and the loaded elevator car exert essentially the same force effect on each other via the elevator ropes. In the position of equilibrium, a half of the nominal load of the elevator is conventionally loaded into the elevator car. The counterweight is in this case dimensioned to correspond to the weight of the elevator car and of one-half of the nominal load. In practice, however, the position of equilibrium varies, owing to e.g. the individual weight differences of the elevator car and the counterweight, as well as to, among other things, the weight of the elevator ropes.

So-called elevator systems without counterweight lack the counterweight that balances the load, so that from the viewpoint of the motor drive of the elevator there is always imbalance of the loading to some degree in the elevator system.

The loading state of an elevator system is conventionally determined from a measurement of the load of the elevator car, e.g. with a load-weighing sensor fixed to the floor of the elevator car or to the elevator ropes. The measurement of the load-weighing sensor almost always contains some degree of measuring error, which is seen in an impairment of the ride comfort of the elevator, particularly when leaving and when the elevator car arrives at a stopping floor. In addition, the measuring error impairs the accuracy of the stopping of the elevator car at the floor.

Publication U.S. Pat. No. 6,283,252 B1 describes a determination of the imbalance of the loading of an elevator on the basis of the measured speed of the motor. The determination is made in a situation when the position of the level of the bottom of the elevator car differs from the stopping level defined by the limit switches. A problem in this case is that only binary information is received from the limit switches as to whether the elevator car is at the stopping level, which adds to the inaccuracy of stopping at the floor and lengthens the movement of the elevator car to the floor in connection with stopping.

PURPOSE OF THE INVENTION

The purpose of the invention is to disclose a determination of the imbalance of the loading of an elevator that is more accurate and faster than prior art.

CHARACTERISTIC FEATURES OF THE INVENTION

Some inventive embodiments are also discussed in the descriptive section of the present application. The inventive content of the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts.

In this context elevator system refers generally to a lifting system intended for lifting people or goods, such as a drum drive elevator or other crane system, and on the other hand elevator system refers also to a passenger elevator or to a freight elevator.

The elevator system according to the invention comprises an elevator car and also a motor drive for moving the elevator car. The loading state of the elevator system according to the invention is in this case determined on the basis of the position deviation of the elevator motor that occurs during the determination of the loading state. The motor drive in this case comprises an elevator motor, which can be e.g. an electric motor, such as a direct-current motor or an alternating-current motor, for instance a synchronous motor. The elevator motor can be a rotating motor or a linear motor. The motor can also be a permanent-magnet motor. The motor drive is connected to the elevator car directly or e.g. via the elevator ropes that support the elevator car. The position deviation of the elevator motor refers in this context to the deviation from the starting position of the motor at the start of the determination of loading. When the loading state is determined on the basis of the position deviation of the elevator motor that occurs during the loading state, the position deviation is determined directly from the position of the rotor of the elevator motor, of the traction sheave or of some other part of the elevator system that moves the elevator car.

In one embodiment of the invention the motor drive comprises a movement reference, which movement reference comprises a speed reference of the motor and also a positive feedback of the torque of the motor. The motor drive comprises an elevator motor, and also a power supply appliance of the motor connected to the elevator motor, which power supply appliance of the motor is fitted to move the elevator motor on the basis of the speed reference of the motor. During the determination of the loading state the speed reference of the motor is determined on the basis of the position deviation of the elevator motor during the determination of the loading state, and during the determination of the loading state the torque reference of the motor is determined on the basis of a comparison between the actual value and the reference value of the speed of the elevator as well as on the basis of the position deviation of the elevator motor. The loading state of the elevator system is determined from the aforementioned torque reference during the determination of the loading state.

In one embodiment of the invention the duration of the determination of the loading state is set in advance.

In one embodiment of the invention the loading state is determined after the machinery brakes of the elevator motor have opened, and the position deviation of the elevator motor is in this case determined starting from the position of the elevator motor while locked with the machinery brakes prior to the determination.

In one movement control of an elevator system according to the invention the movement of the elevator car is set with the motor drive according to the movement reference. The movement reference here comprises a speed reference of the elevator motor and also positive feedback of the torque of the elevator motor. The positive feedback of the torque of the elevator motor is determined on basis of at least on the position deviation of the elevator motor that occurs during the determination of the loading state of the elevator system. Speed reference refers to the reference value curve of speed, which changes according to time or e.g. the position or location of the motor or of the elevator car, which reference value curve is comprised of consecutive reference values one following the other. Positive feedback of the torque of the motor refers to the reference value curve of the positive feedback of torque, which is comprised in a corresponding manner from the reference values of the positive feedback of torque. The speed reference and the positive feedback of torque can be continuous or discrete.

In one method according to the invention for determining the loading state of an elevator system a motor drive is fitted to the elevator system for moving the elevator car. In the method the position deviation of the elevator motor is determined, and also the loading state of the elevator system is determined on the basis of the position deviation of the elevator motor.

In one method according to the invention for controlling the movement of an elevator system the movement of the elevator car is set with the motor drive; the position deviation of the elevator motor is determined during the determination of the loading state of the elevator system; the positive feedback of the torque of the motor is determined on the basis of at least the aforementioned position deviation of the elevator motor; and also the elevator motor is controlled on the basis of the movement reference.

ADVANTAGES OF THE INVENTION

With the invention at least one of the following advantages, among others, is achieved:

when the loading state of the elevator system is determined on the basis of the position deviation of the elevator motor that occurs during the determination of the loading state, the determination is more accurate than prior art because in this case any errors of imbalance of the loading of the elevator system will be compensated more accurately than in those prior-art solutions in which imbalance is determined with e.g. the load-weighing sensor of the elevator car. By means of the determination according to the invention, the imbalance caused by the non-idealities of the mechanics of the elevator system, such as imbalance caused by the individual weight variations of the elevator car and the counterweight, or imbalance caused by the weight of the elevator ropes, can also be compensated. Additionally, by means of the determination it is possible to also resolve problems resulting from the measuring inaccuracies of the load-weighing sensor, such as offset of the load-weighing sensor and amplification error. Furthermore, since a separate load-weighing sensor of the elevator car is not necessarily needed for the determination, the elevator system becomes cheaper, simpler and at the same time more reliable than a prior-art one.

In one embodiment of the invention the reference value of the current that is proportional to the torque of the elevator motor is formed in response to the magnitude of the position deviation between the rotor and the stator of the elevator motor that occurs during the determination of the loading state, which position deviation is determined starting from the starting position between the rotor and the stator prior to the determination; In this case the current and thus the torque of the elevator motor can be regulated as a function of the change in position between the rotor and the stator more accurately than in prior-art solutions, in which regulation of the current/torque occurs with the speed regulator on the basis of the difference between the reference value and the actual value of the speed of the rotor. Also the movement of the elevator motor during the determination essentially decreases, which improves the drive comfort of the elevator and also the safety of the operation of the elevator. The torque regulation of the motor can in this case be implemented without a speed regulator such that the current supplied to the motor is regulated with the current regulator to correspond to the reference value of current, and the polarity of the current is selected such that the torque of the motor produced by the current is in the opposite direction to the change in position between the rotor and the stator, thus endeavoring to prevent the aforementioned change in position. In this case the torque of the motor adjusts to compensate the imbalance of the elevator system, endeavoring to keep the elevator car in its position in the elevator hoistway, and the loading state of the elevator system can be determined from the current and/or from the reference value of the current of the elevator motor without movement of the elevator motor impairing the ride comfort of the elevator.

In one embodiment of the invention the reference value of the current proportional to the torque of the elevator motor is additionally formed from the output of the speed regulator during the determination of the loading state, which output of the speed regulator is set on the basis of the speed reference of the motor and also of the measured value of the speed of the motor, which speed reference of the motor is formed in response to the magnitude of the position deviation between the rotor and the stator of the elevator motor that occurs during the determination of the loading state. In this case the movement between the rotor and the stator of the elevator motor is further dampened, in which case the movement of the elevator motor can be stabilized.

If the loading state of the elevator system is determined both with the determination according to the invention and also with a prior-art load-weighing sensor of the elevator car, the determination is more accurate than in those prior-art elevator systems in which imbalance is determined only with the load-weighing sensor of the elevator car. In this case the accuracy of the determination of the loading state of the elevator system can be increased also in those elevator systems that already comprise the aforementioned load-weighing sensor of the elevator car.

When the loading state of the elevator system is determined as presented in the invention on the basis of the position deviation of the elevator motor, the determination is quick and it can be done e.g. at the start of a run after the machinery brakes have opened.

When the loading state of the elevator system is deduced to be determined after the values of the change of speed of the elevator or of the change of the torque reference of the elevator motor have decreased to within the range of permitted values set for environs of zero, the duration of the determination can be minimized.

When the positive feedback of the torque of the elevator motor is determined on basis of the position deviation of the elevator motor that occurs during the determination of the loading state of the elevator system, the improvement in the accuracy of the determination also affects the ride quality of the elevator owing to the improvement in the accuracy of the positive feedback of the torque, because the measuring errors of the load-weighing sensors of the car, and the errors of the positive feedback of torque caused by this, have conventionally caused extra vibration in the elevator car, particularly at the start of a run and at the end of a run, when the elevator car approaches the stopping level. At the same time the accuracy of the stopping of the elevator car at the floor improves.

When the positive feedback of the torque of the motor is determined on the basis of the position deviation of the elevator motor that occurs during the determination of the loading state of the elevator system, the positive feedback of the torque of the motor no longer needs to be separately determined on the basis of the determination of the loading state, which reduces calculation of the movement reference and at the same time speeds up control of the movement.

In one embodiment of the invention, the starting value of the speed reference in the drive mode of the elevator is determined on the basis of the speed reference during the determination of the loading state. In this case the speed reference is continuous, which improves the ride quality of the elevator.

In one embodiment of the invention both the speed of the elevator motor and the position of the elevator motor is determined from an encoder connected to the rotating shaft of the elevator motor or e.g. to the traction sheave. The magnitude of the angle of rotation of the encoder can be determined directly on the basis of the measured encoder pulses, in which case an encoder is suited for use in determining the position deviation between the rotor and the stator of the elevator motor.

PRESENTATION OF DRAWINGS

Figure 2:
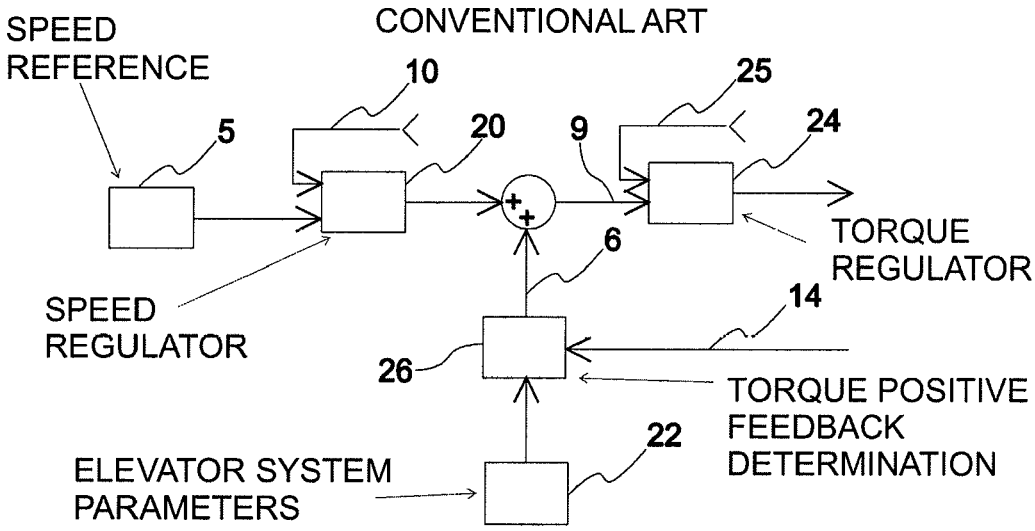
Figure 3:
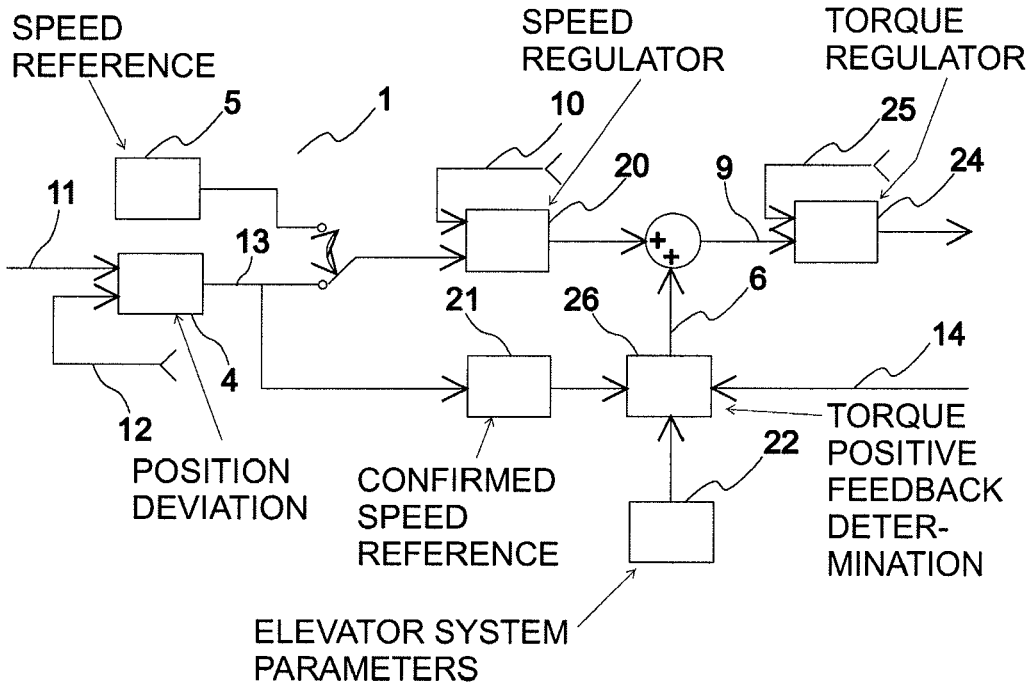

In the following, the invention will be described in more detail by the aid of a few examples of its embodiments with reference to the attached drawings, wherein FIG. 1 presents an elevator system according to the invention FIG. 2 presents a movement control of an elevator system according to prior art FIG. 3 presents a determination of the loading state of an elevator system according to the invention

EMBODIMENTS

FIG. 1 presents one elevator system according to the invention. The elevator car 2 and the counterweight 17 are moved in the elevator hoistway with the elevator motor 7 supported by the ropes 18. The power supply of the elevator motor 7 occurs from the electricity network 15 through a frequency converter 8. The frequency converter 8 sets the motor 7 and at the same time via the elevator ropes 18 also the elevator car 2 according to the movement reference. The frequency converter 8 in this case sets the torque of the motor 7 according to the torque reference 9. The movement control measures the speed 10 and also the position 12 of the motor 7 with an encoder 16 fitted to the traction sheave so as to be friction-operated. The encoder 16 can also be fitted to the shaft of the motor 7, in which case particularly the accuracy of the position measurement 12 improves.

The elevator car 2 is moved from floor to floor in the elevator hoistway. The positions of the landings are indicated with the sensors of the stopping floor. When the elevator car has stopped at a floor, the movement of the elevator car is prevented by locking traction sheave of the elevator motor 7 with the machinery brakes. When a new run starts the machinery brakes open, in which case the elevator car is held in position with the torque of the elevator motor such that it is endeavored to compensate the imbalance of the loading of the elevator system with the torque produced by the motor.

In this case, after the brakes have opened the loading state of the elevator system is determined on the basis of the position deviation 4 of the elevator motor that occurs during the determination 1 of the loading state. The position deviation is determined starting from the position 11 of the elevator motor while locked with the machinery brakes prior to the determination. The loading state of the elevator system is deduced to be determined when the values of the change of speed 10 of the elevator or of the change of the torque reference 9 of the elevator motor have been for a set time within the range of permitted values set for environs of zero. In other words, when the absolute value of the change in speed or of the change in the torque reference has remained sufficiently small for the desired time, it is deduced that the loading state is determined and the elevator starts to drive to the destination floor. In this case also the positive feedback of the torque of the elevator motor used in the movement control is determined during the determination of the loading state. In this embodiment of the invention the loading state of the elevator and the positive feedback of the torque of the elevator motor are also determined with a separate load-weighing sensor 14 fixed to the floor of the elevator car 2, but it is also possible that a separate load-weighing sensor is not used.

FIG. 2 presents a prior-art movement control of an elevator system. The movement of the elevator motor 7 is set with the speed regulator on the basis of the comparison of the speed reference 5 of the motor and the value 10 of the measured speed of the motor. A signal that is proportional to the torque reference of the elevator motor is received as the output of the speed regulator. In addition to this signal, the torque reference 9 is also formed from a so-called positive feedback 6 of torque. The positive feedback of torque refers to an estimate that is independent of the speed regulator and based on the loading of the elevator system, on the control situation or e.g. on the position of the elevator car, or is time-determined, of the need for torque of the elevator motor. Here the positive feedback of torque is determined with the load-weighing sensor of the elevator car from measured signal 14 expressing the loading of the elevator car. Additionally, certain parameters 22 of the elevator system, such as the mass of inertia of the elevator moved in the elevator hoistway, affect the determination of the positive feedback of the torque. The movement control also comprises a torque regulator 24, which endeavors to set the torque of the elevator motor according to the torque reference 9. The torque of the elevator motor is here proportional to the current of the elevator motor, so that the measurement of the current of the elevator motor functions as a measurement feedback 25 of torque, and the current regulator functions as the torque regulator 24.

FIG. 3 presents one determination 1 of the loading state of an elevator system according to the invention. In this case the determination 1 of the loading state is fitted in connection with the movement control of the elevator system presented in FIG. 2. When the machinery brakes of the elevator motor are opened, the determination 1 of the loading state starts to determine the position deviation 5 of the elevator motor. The deviation is determined by comparing the position 12 of the rotor of the elevator motor to the starting position that the rotor had at the beginning of the determination. On the basis of this comparison, a speed reference 13 of the elevator motor during the determination of the loading state is formed, which speed reference is taken to the speed regulator 20. In addition, the aforementioned speed reference 13 of the elevator motor is taken, as confirmed 21, to the determination 26 of the positive feedback 6 of the torque of the elevator motor. The loading signal 14 of the elevator car measured with the load-weighing sensor is here also for the determination of the positive feedback 6, but the determination of the loading state according to the invention does not necessarily comprise a load-weighing sensor/loading signal 14, in which case the positive feedback 6 is determined completely without a separate load-weighing sensor.

In FIG. 3 the torque reference 9 of the elevator motor is formed by means of the output signal of the speed regulator 20 and also of the positive feedback 6 of the torque. The measured speed signal 10 of the elevator is derived, and the absolute value of the derivative is calculated. The absolute value is compared to a range of permitted values set for the environs of zero, and when the absolute value has been in the permitted area for a set time, the loading state of the elevator system is deduced to be determined. In this case the loading state can be caused by the torque reference 9. By means of the determined loading state, possible overloading of the elevator car can also be monitored. When the determination of the loading state is completed, the motor drive 3 prepares to drive the elevator car 2 to the destination floor according to the drive mode of the movement control. In this case the positive feedback 6 of torque based on the position deviation 4 of the elevator motor and formed in connection with the determination of the loading state is recorded, and the recorded positive feedback is used to form the movement reference during drive mode. In drive mode the movement of the elevator motor 7 and thus also of the elevator car 2 is set according to the speed reference 5. In other words, when drive mode starts the symbolic switch presented in FIG. 3 changes its state, and the speed reference 5 of the drive mode is taken to the speed regulator 20. In this case, however, the starting value of the speed reference 5 of drive mode is determined on the basis of the speed reference 13 during determination of the loading state, in which case the starting value of the speed reference 5 of drive mode is the same as the speed reference at the end of the speed reference 13 during determination of the loading state, and the speed reference is continuous.

The invention is described above by the aid of a few examples of its embodiment. It is obvious to the person skilled in the art that the invention is not limited to the embodiments described above, but that many other applications are possible within the scope of the inventive concept defined by the claims presented below.

The invention claimed is:

1. A determinator of the loading state of an elevator system, which elevator system comprises an elevator car and a motor for moving the elevator car, comprising:

a position deviation calculator determining the loading state of the elevator system by comparing a position of a rotor of the motor after a determination period to a starting position of the rotor at the start of the determination period to calculate a first reference value; and a torque regulator, the torque regulator setting the torque of the motor based on the first reference value.

2. The determinator according to claim 1, further comprising:

a speed reference outputting a second reference value;

a speed regulator, the speed regulator receiving a measured motor speed and comparing the measured motor speed to either the first reference value or second the reference value to produce an output, the speed regulator output being sent to the torque regulator.

3. The determinator according to claim 2, further comprising: a positive feedback of the torque of the motor, a power supply appliance of the motor connected to the motor, the power supply appliance of the motor fitted to move the elevator motor on the basis of the output of the torque regulator, wherein the output of the torque regulator by a comparison of the output of the speed regulator and a measured torque.

4. The determinator according to claim 1, wherein the duration of the determination period is set in advance.

5. The determinator according to claim 1, wherein the loading state of the elevator system is determined when the values of the change of speed of the elevator or of the change of the torque reference of the elevator motor have been within the range of permitted values for a set time.

6. The determinator according to claim 1, wherein the loading state is determined after a machinery brake of the elevator motor has opened, and the starting position of the of the rotor is when the machinery brake is locked.

7. The determinator according to claim 1, wherein the determination of the loading state is implemented without a separate measurement feedback from the load-weighing sensor of the elevator car.

8. The determinator according to claim 1, further comprising a switch selectively connecting the speed regulator with either the speed reference or the position deviation calculator.

9. A method for determining the loading state of an elevator system, which elevator system comprises an elevator car and also a motor for moving the elevator car, comprising:

determining the loading state of the elevator system by comparing a position of a rotor of the motor after a determination period to a starting position of the rotor to calculate a position deviation; and setting the torque of the motor by inputting the position deviation to a torque regulator.

10. The method of claim 9, wherein setting the torque further comprises comparing the position deviation to a measured torque.

* * * * *